US006840665B2

(12) United States Patent
Castro

(10) Patent No.: US 6,840,665 B2
(45) Date of Patent: Jan. 11, 2005

(54) BALANCE WATCH

(76) Inventor: Paul John Castro, 1933 18th St., #201, Santa Monica, CA (US) 90404

( * ) Notice: Subject to any disclaimer, the term of this patent is extended or adjusted under 35 U.S.C. 154(b) by 359 days.

(21) Appl. No.: 10/193,966

(22) Filed: Jul. 10, 2002

(65) Prior Publication Data

US 2004/0008590 A1 Jan. 15, 2004

(51) Int. Cl.[7] ..... A44C 5/00
(52) U.S. Cl. ..... 368/281; 368/80; 368/283
(58) Field of Search ..... 368/76, 80, 121, 368/238, 281–283

(56) References Cited

U.S. PATENT DOCUMENTS

| | | | | | |
|---|---|---|---|---|---|
| 239,738 | A | | 4/1881 | Dee | |
| D286,754 | S | | 11/1986 | Manfredi | D10/39 |
| 4,991,154 | A | * | 2/1991 | Perucchi | 368/76 |
| 5,103,434 | A | | 4/1992 | Sullivan | 368/238 |
| D329,020 | S | | 9/1992 | Iwata | D10/30 |
| 5,280,461 | A | * | 1/1994 | Belik | 368/228 |
| D386,976 | S | | 12/1997 | Campilan | D10/30 |
| 5,894,457 | A | * | 4/1999 | Luth | 368/108 |
| 6,322,245 | B1 | * | 11/2001 | Cooper | 368/276 |

OTHER PUBLICATIONS www.kamlahands.com/hands.htm May 6, 2002.

* cited by examiner

*Primary Examiner*—Kamand Cuneo
*Assistant Examiner*—Thanh S. Phan
(74) *Attorney, Agent, or Firm*—Cislo & Thomas LLP

(57) ABSTRACT

A balance watch, a combination of two watches, one measuring hours, the other measuring minutes and/or seconds. Each watch is worn on a separate wrist simultaneously.

18 Claims, 4 Drawing Sheets

4a

4b

BALANCE WATCH

BACKGROUND OF THE INVENTION

1. Field of the Invention

This invention relates to timepieces, and in particular to watches.

2. Description of the Related Art

For many centuries people have been trying to keep track of time. The earliest known timepiece used by man was the sundial. Eventually civilization progressed to the hourglass, and then to the mechanical clock. Initially, mechanical clocks were heavy and inaccurate, and only measured the hour with a single hand.

Eventually, clocks became smaller and smaller and developed into watches. As watches became more accurate, they indicated hours and minutes with two separate hands. Finally, a third hand showed the seconds as well.

People today usually own one or more watches. There are watches for runners and swimmers, watches with calendars, calculators, printers, and tiny computer boards. Along with technological advances have come advances in styling and design. In addition to being functional, the modern watch has also become a piece of jewelry to be worn with pride. No other item in our lives is worn every day, often knocked about, and still expected to constantly perform perfectly and look great. In short, watches have become more than simply a timekeeping device. To this end, various approaches have emerged to satisfy the varied and diverse needs of watch users.

U.S. Pat. No. 5,103,434 discloses an analog timepiece with a rotating face and a single hand attached to the face. As the face rotates, the position of the hand relative to the outer edge of the timepiece indicates the hour, and the position of the hand relative its location indicates the minutes.

U.S. Pat. No. 4,991,154 discloses a timepiece including an analog-type display for displaying minutes, and a digital-type display for displaying the hour.

U.S. Pat. No. 239,738 discloses a watch or pocket timekeeper with two dials, one in front and one in back, where one dial indicates hours, and the other indicates minutes.

Despite these previous attempts, a need exists for a coordinated wristwatch pair, that each provide a different measure of time, while allowing a wearer to fashionably display a watch on each wrist.

SUMMARY OF THE INVENTION

In view of the foregoing disadvantages inherent in the known types of watches now present in the prior art, the present invention provides a balance watch set, comprising a first watch, including a dial with a hand for measuring minutes, and a band for attaching the first watch to a wrist, a second watch, including a dial with a hand for measuring hours, and a band for attaching the second watch to the opposite wrist, where the first watch and the second watch are worn on opposite wrists simultaneously. In an alternative embodiment, the first watch includes a hand for measuring seconds. The bands of the watches can be made of leather, cloth, a polymeric material, metal, or of any combination of these materials. In another alternative embodiment, the first and second dials have digital displays. In fact, any desired combination of analog and digital displays may be used so long as two watches are used, and they are worn on opposite wrists.

The general purpose of the present invention, which will be described subsequently in greater detail, is to provide a new balance watch set that signals a perceived balance, which is not anticipated, rendered obvious, suggested, or even implied by any of the prior art watches either alone or in any combination thereof.

DESCRIPTION OF THE PREFERRED EMBODIMENT(S)

The detailed description set forth below in connection with the appended drawings is intended as a description of presently-preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

A balance watch of the present invention comprises a first watch, including a dial with a hand for measuring minutes, and a band for attaching the first watch to a wrist, a second watch, including a dial with a hand for measuring hours, and a band for attaching the second watch to the opposite wrist, where the first watch and the second watch are worn on opposite wrists simultaneously.

In an alternative embodiment, the first watch includes a hand for measuring seconds.

In another alternative embodiment, the first and second dials have digital displays. In fact, any desired combination of analog and digital displays may be used so long as two watches are used, and they are worn on opposite wrists.

The watches may be of any shape, such a circular, rectangular or polygonal. The operating mechanism is preferably an automatic mechanical mechanism, but may also be powered by a manual mechanical mechanism, a quartz mechanism, battery power an electromechanical mechanism, or a liquid crystal device using ferroelectric liquid crystals.

The dials are of conventional construction, and may have numbers and time markings either applied or printed on the face of the dial. The dials may be formed from metal, porcelain, stone, or any other suitable material, and may be enclosed by a clear material known in its art, such as crystal. The dials may include either a lighted or analog display. If an analog display is selected, standard watch hands may be used, such as, but no limited to those with parallel or angled hands, square, rounded or angled tips. On the other hand, if a digital display is used, the numerals or digits may be mechanical, such as a rotating design, or electronic, such as a liquid crystal display (LCD), using ferroelectric liquid crystals.

The bands are of conventional design, and may be formed from leather, metal, cloth or a polymeric material as dictated by customer preferences. For example, a balance watch for formal occasions may include a band of leather or metal, whereas a balance watch for athletic activities may be formed from leather or metal, but may also be formed from cloth or a polymeric material, such as plastic or hardened rubber. The band may be attached to the wrist by a buckle type device, a snap-type device, Velcro, or elasticity.

Figure 1:
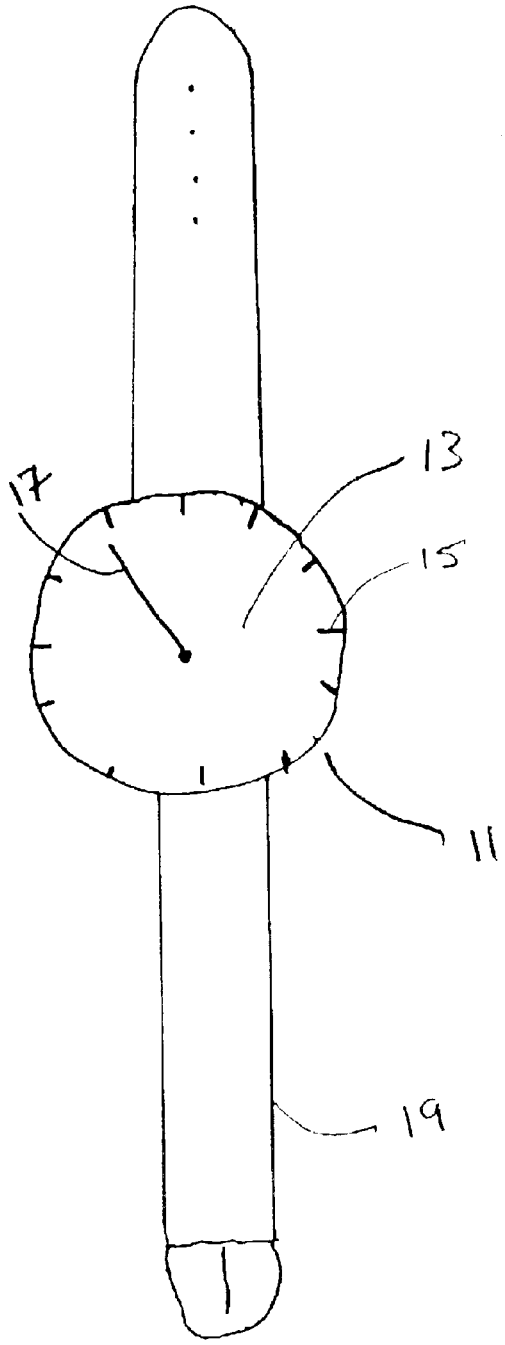
FIG. 1 is an elevation view of an hour-measuring portion of a balance watch.

Referring to the Figures, FIG. 1 shows an embodiment of the hour-measuring portion of the balance watch. Watch 11 includes dial 13 the dial 13 is preferably constructed of porcelain with gradations 15 spaced apart to indicate hours. The gradations 15 are of any suitable material and are applied to the dial 13 by known techniques. Hour band 17 is positioned and rotated in the conventional manner, and is preferable of a parallel round tipped design for ease of reading, but may be of any suitable design that allows it to function as an hour measuring instrument. Band 19 is shown as employing a buckle, which may be used with any material used to form the band. Alternatively, Velcro, elasticity or a snap setting work equally well.

Figure 2:
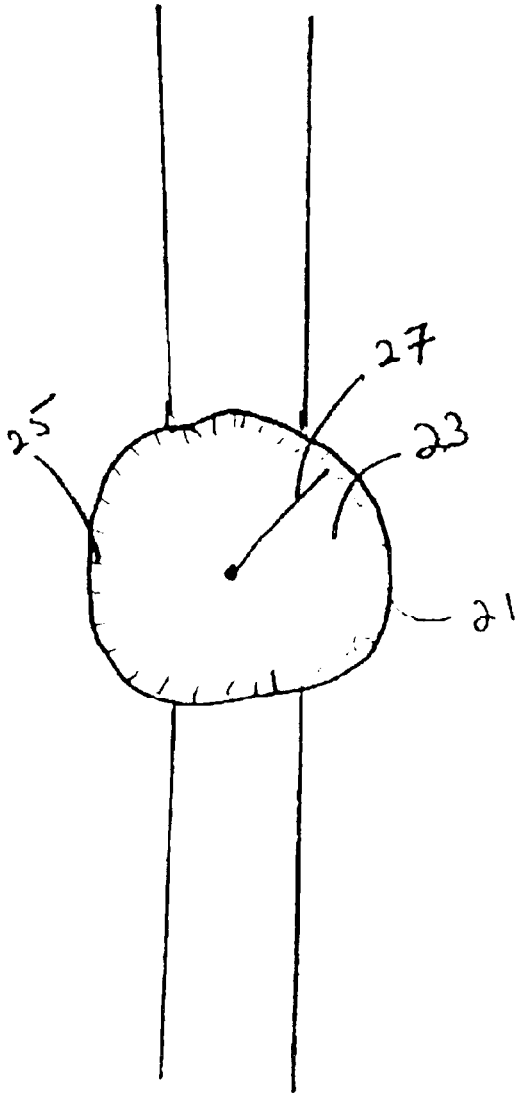
FIG. 2 is an elevation view of a minute-measuring portion of a balance watch.

FIG. 2 shows an embodiment of the minute measuring portion of the balance watch, where watch 21 includes a dial 23 with gradations 25 spaced apart to indicate minutes in combination with minute hand 27.

Figure 3:
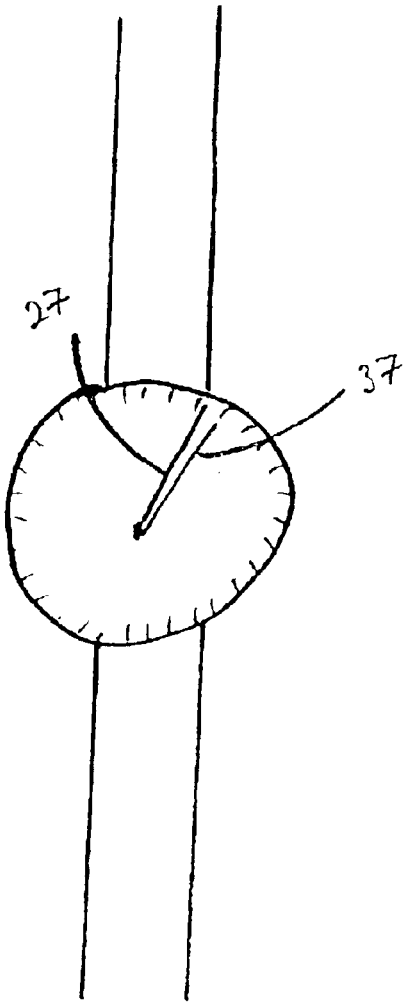
FIG. 3 is an elevation view of a minute-measuring portion of a balance watch that includes a second-measuring hand.

FIG. 3 illustrates an alternative embodiment of the minute measuring portion of the balance watch that includes second hand 37. Preferably, second hand 37 differs in size from minute hand 27 for ease of reading. The size difference may be in length, width, or both. Alternatively, any method of distinguishing the hands, such as color, is also acceptable.

Figure 4:
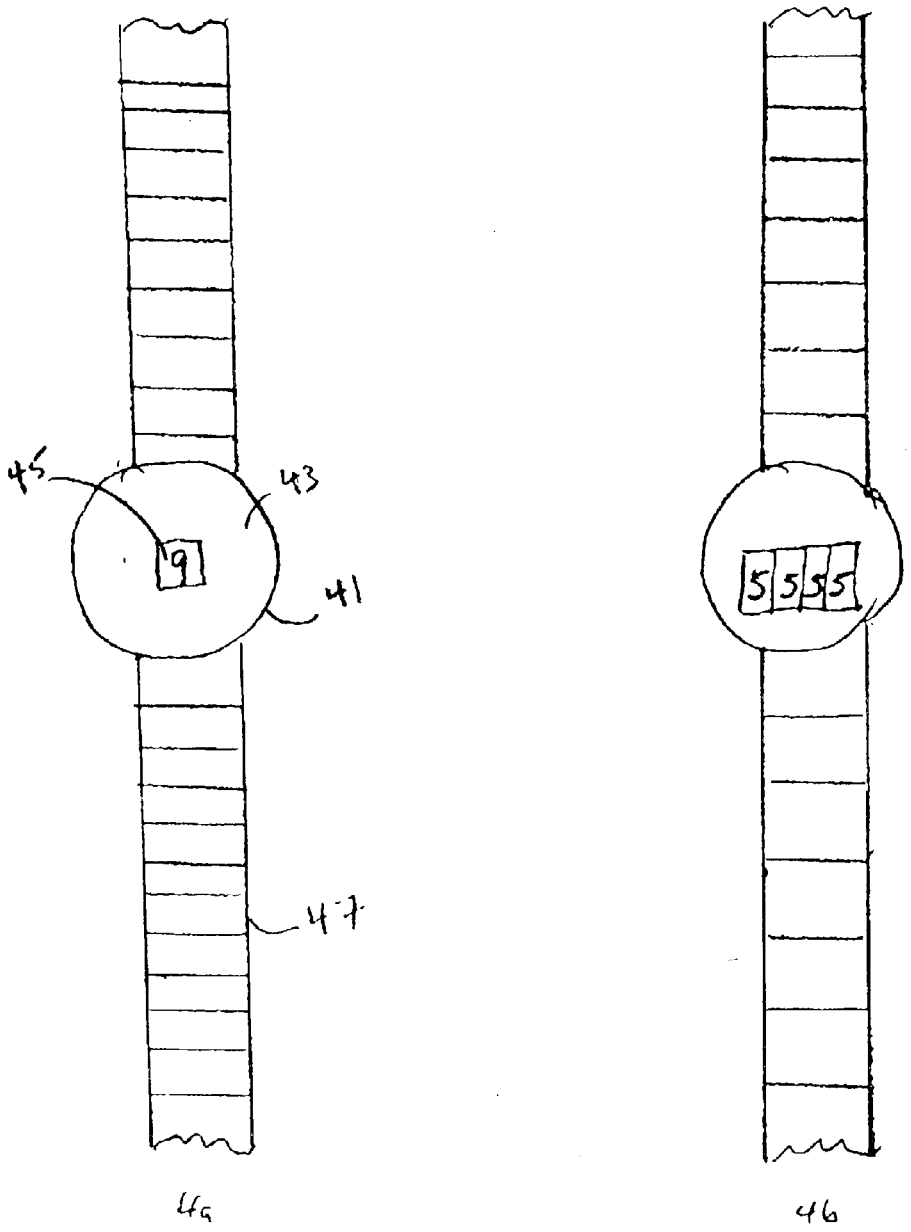
FIG. 4 is an elevation view of a complete balance watch with digital dials.

FIG. 4 depicts an embodiment of the invention that incorporates digital time measuring means. Referring to FIG. 4*a*, watch 41 includes dial 43, and digital display 45 shown here measuring the hour. Digital display 45 is preferably a rotating mechanical display, but may also be an LED or other digital display apparatus. Wrist band 47 may be of any style previously described, but is shown in FIG. 4 as an expanding metal band.

The second portion of the balance watch shown in FIG. 4*b* is similar to the portion depicted in FIG. 4*a* except that it is shown to measure minutes and seconds.

In addition to the embodiment described above, other embodiments may include luminous dials, battery powered lights, combined digital and analog displays, stopwatch functions, alarms, or any other enhancement that can be applied to two watches worn simultaneously.

In use, a wearer selects a watch for each wrist, depending on which wrist is preferred for obtaining the hour of the day, and which is preferred for obtaining minutes and/or seconds.

While the present invention has been described with regards to particular embodiments, it is recognized that additional variations of the present invention may be devised without departing from the inventive concept.

What is claimed is:

1. A balance watch set, comprising:

a first watch, including a dial with means for only measuring minutes corresponding to the current time of the day, and a band for attaching said first watch to a first wrist;

a second watch, including a dial with means for only measuring hours corresponding to the current time of the day, and a band for attaching said second watch to an opposite wrist;

whereby said first and second watches are worn by an individual to signal perceived balance.

2. The balance watch set of claim 1, wherein the first watch includes means for measuring seconds.

3. The balance watch set of claim 2 wherein the first and second bands are made of leather.

4. The balance watch set of claim 2 wherein the first and second bands are made of cloth.

5. The balance watch set of claim 2 wherein the first and second bands are made of a polymeric material.

6. The balance watch set of claim 2 wherein the first and second bands are made of metal.

7. The balance watch set of claim 1 wherein means for measuring comprise digital displays.

8. The balance watch set of claim 7 wherein the first and second bands are made of leather.

9. The balance watch set of claim 7 wherein the first and second bands are made of cloth.

10. The balance watch set of claim 7 wherein the first and second bands are made of a polymeric material.

11. The balance watch set of claim 7 wherein the first and second bands are made of metal.

12. The balance watch set of claim 1 wherein the means for measuring comprise hands.

13. The balance watch set of claim 12 that includes a hand for measuring seconds.

14. The balance watch set of claims 13 wherein the first and second bands are made of leather.

15. The balance watch set of claims 13 wherein the first and second bands are made of cloth.

16. The balance watch set of claims 13 wherein the first and second bands are made of a polymeric material.

17. The balance watch set of claim 13 wherein the first and second bands are made of metal.

18. The method of fashion and attitude display of time comprising:

a. wearing a first watch which indicates only hours corresponding to the current time of the day on one wrist; and b. wearing a second watch which indicates only minutes corresponding the current time of the day on the other wrist, said second watch being consequently configured to said first watch.

* * * * *